US006915900B2

(12) United States Patent
Chen

(10) Patent No.: US 6,915,900 B2
(45) Date of Patent: Jul. 12, 2005

(54) COMBINATION OF TOOL BOX AND HANGING MEMBERS

(76) Inventor: Chang-Ying Chen, No. 5, Lane 320, Shihu Rd., Dali City, Taichung (TW)

( * ) Notice: Subject to any disclaimer, the term of this patent is extended or adjusted under 35 U.S.C. 154(b) by 156 days.

(21) Appl. No.: 10/403,300

(22) Filed: Apr. 1, 2003

(65) Prior Publication Data

US 2004/0195128 A1 Oct. 7, 2004

(51) Int. Cl.[7] ..... B65D 85/20

(52) U.S. Cl. ..... 206/350; 206/372; 206/379; 206/806; 206/818; 224/197; 224/667; 224/668; 224/682; 224/904

(58) Field of Search ..... 206/349, 372–379, 206/806, 818, 350; 211/70.6; 224/197, 667, 668, 669, 680, 682, 683, 904

(56) References Cited

U.S. PATENT DOCUMENTS 3,477,677 A * 11/1969 Hindley ..... 248/220.31
4,934,530 A * 6/1990 Riess ..... 206/379
5,489,051 A * 2/1996 Robinson ..... 224/148.4
5,535,882 A * 7/1996 Liu ..... 206/377
D375,404 S * 11/1996 Moffitt ..... D3/228
6,547,074 B1 * 4/2003 Chen ..... 206/379
2002/0092786 A1 * 7/2002 Shu ..... 206/379
2003/0062279 A1 * 4/2003 Lam ..... 206/350

* cited by examiner

*Primary Examiner*—Mickey Vu
*Assistant Examiner*—Jerrold Johnson

(57) ABSTRACT

A tool box includes a base and a cover which is pivotably connected to the base and has a magnetic member connected to an inside thereof so as to attract small pieces. A hanging member has a hook portion connected to a first end thereof so as to be attached to a user's belt and an engaging member is connected to the hook portion. A board has two ridges on a side thereof and the tool box is clamped between the two ridges. A hole is defined through the board and the engaging member is rotatably engaged with the tool box.

7 Claims, 7 Drawing Sheets

COMBINATION OF TOOL BOX AND HANGING MEMBERS

FIELD OF THE INVENTION

The present invention relates to a tool box that is pivotably connected to a board which is attached to the user's belt and the tool box has a magnetic cover for positioning small pieces.

BACKGROUND OF THE INVENTION

A conventional tool box generally includes a base and a cover which is pivotably connected to base. The base and/or the cover have recesses so as to receive tools and small pieces. The tool box has to be carried by the users and could be a burden if the users work on a ladder or if both hands of the users are occupied. Besides, small pieces such as screwdriver bits, screws or nuts generally are put randomly so that the user has to take a lot of time to find them. The small pieces could be lost because the conventional tool boxes do not provide proper receiving areas to receive them.

The present invention intends to provide a combination tool box and hanging members which attach the tool box on user's belt and the tool box has a magnetic cover for the small pieces.

SUMMARY OF THE INVENTION

In accordance with one aspect of the present invention, there is provided a combination of tool box and hanging members, wherein the tool box has a base and a cover which is pivotably connected to the base and a magnetic member is connected to an inside of the cover. The base has a receiving hole defined therethrough. A board has a first part which has a first hole defined therethrough.

A hanging member has a hook portion connected to a first end thereof and an engaging member is connected to the hook portion and rotatably engaged with the receiving hole via the first hole in the board.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
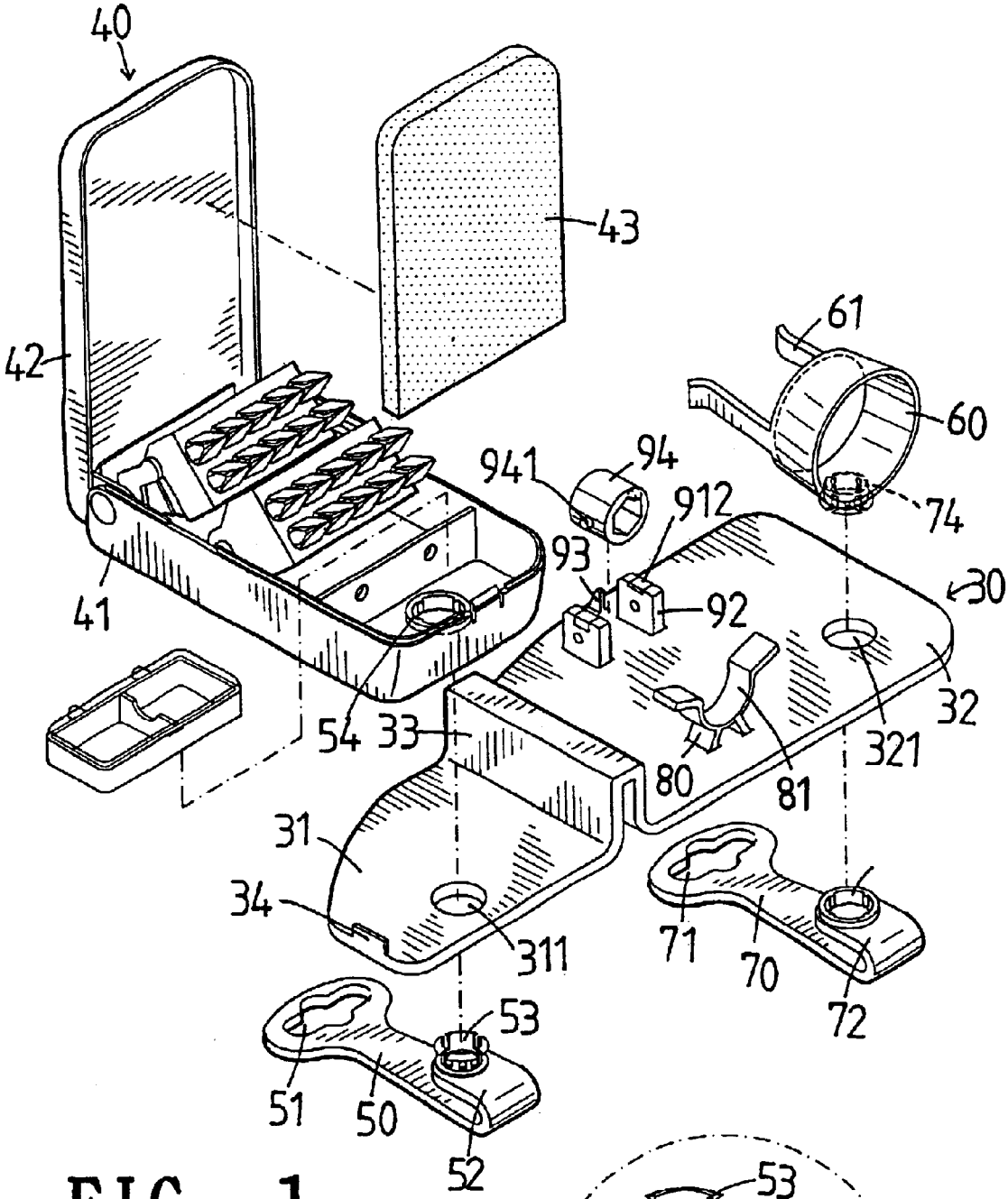
FIG. 1 is an exploded view to show the tool box, the board and the hanging members.
Figure 2:
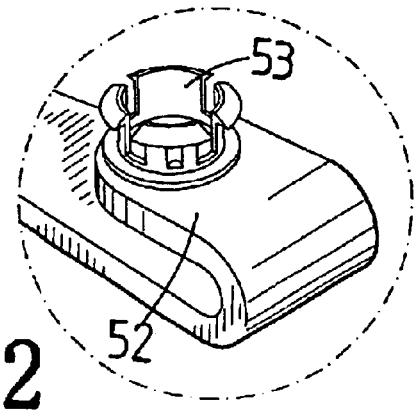
FIG. 2 shows the engaging member on the hook portion of the hanging member.

Referring to FIGS. 1 to 7, the present invention comprises a board 30 having a first ridge 33 and a second ridge 34 respectively extending from a side thereof. The board 30 includes a first part 31 and a second part 32, and the first ridge 33 is located between the first part 31 and the second part 32. A first hole 311 is defined through the first part 31 and a second hole 321 is defined through the second part 32.

Figure 3:
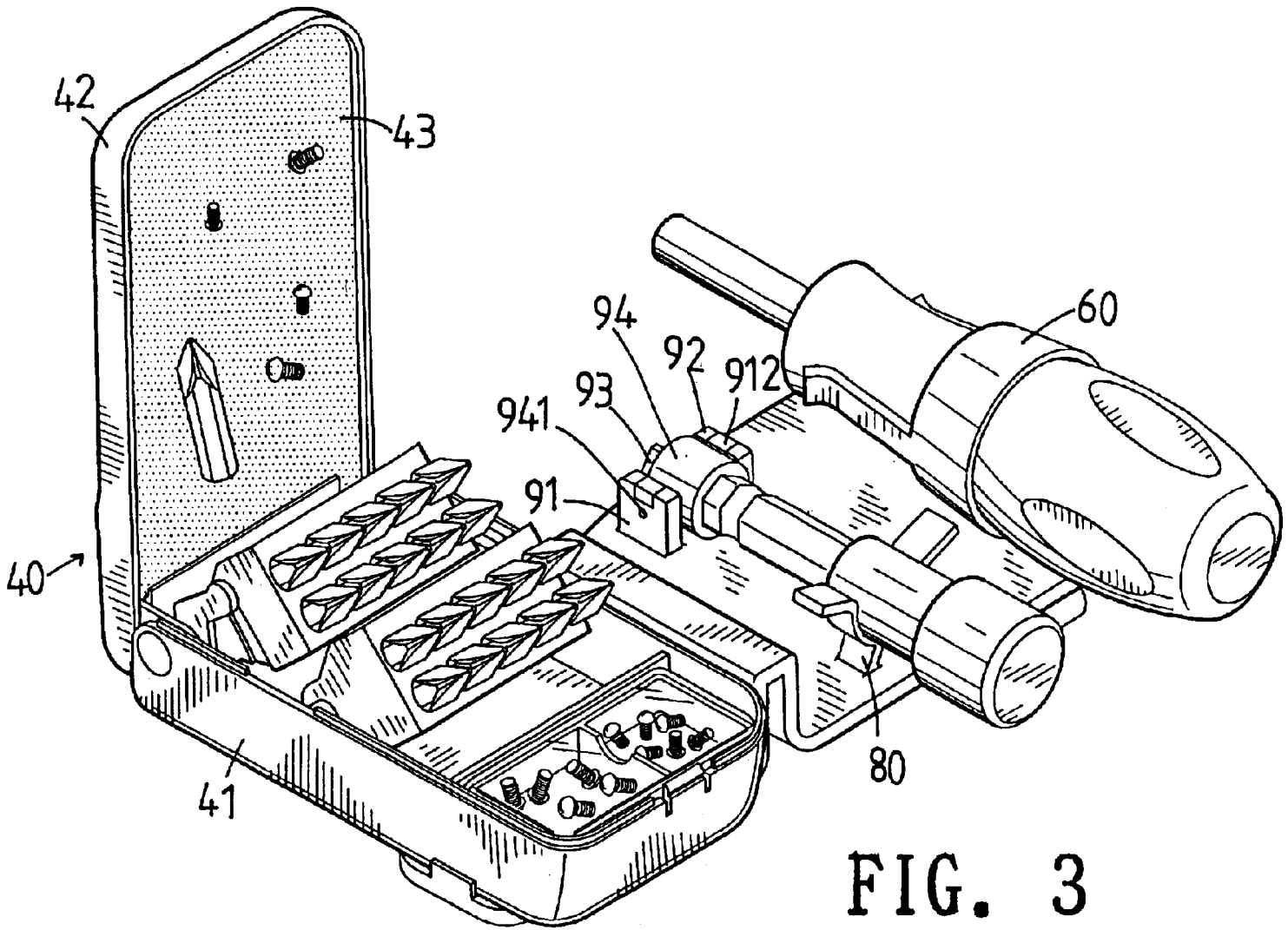
FIG. 3 is a perspective view to show the tool box on the first part of the board and two tools on the second part of the board.
Figure 4:
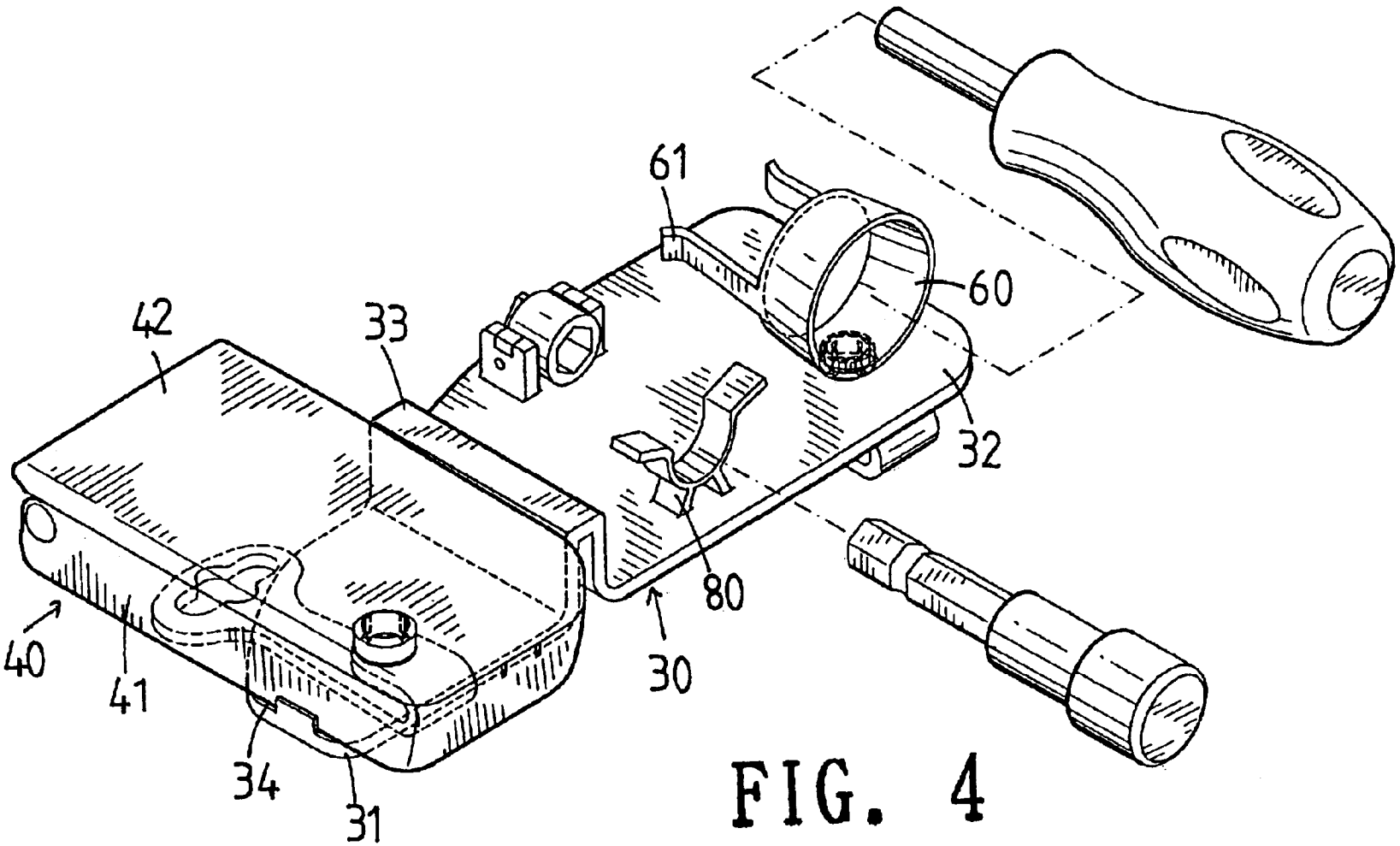
FIG. 4 is an exploded view to show the two tools and the board.
Figure 5:
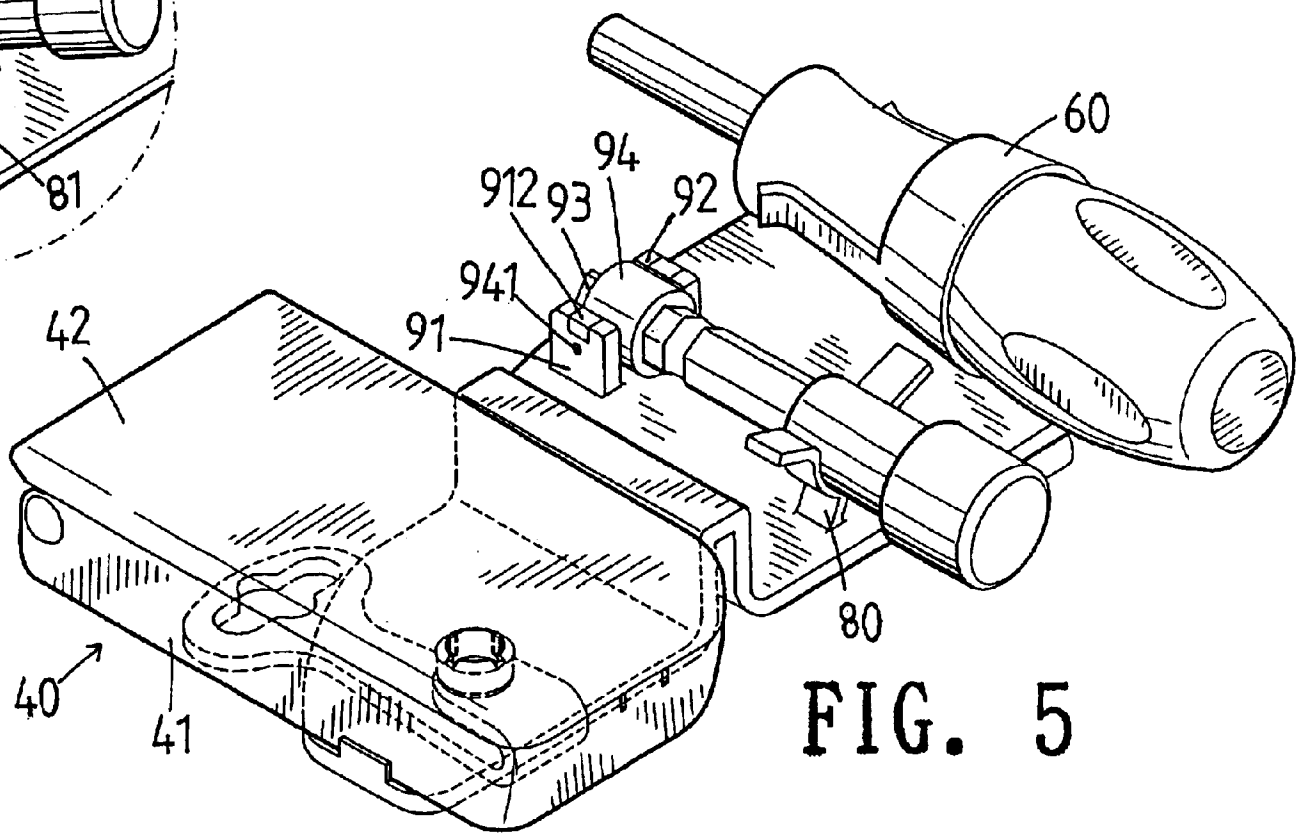
FIG. 5 is a perspective view to show the tool box on the first part of the board and two tools on the second part of the board.

A tool box 40 has a base 41 and a cover 42 which is pivotably connected to the base 41. The base 41 is clamped between the first ridge 33 and the second ridge 34, and has a first receiving hole 54 defined therethrough. A box is put in the base 41 to cover the first receiving hole 54 up. A magnetic member 43 is connected to an inside of the cover 42 which can be opened about 90 degrees relative to the base 31 as shown in FIG. 3.

Figure 6:
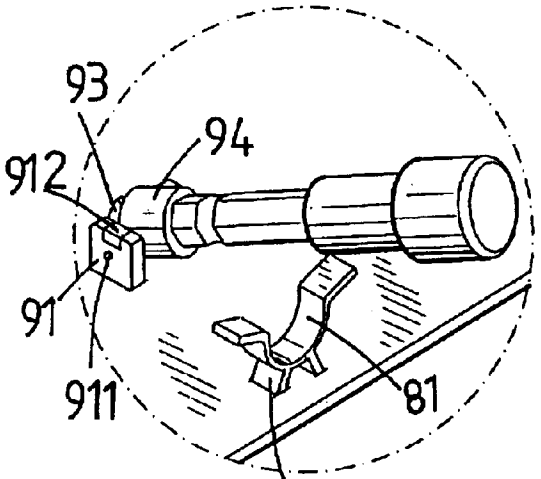
FIG. 6 shows one of the tools is connected with a pivoted a socket which is pivotably connected between two frames.
Figure 7:
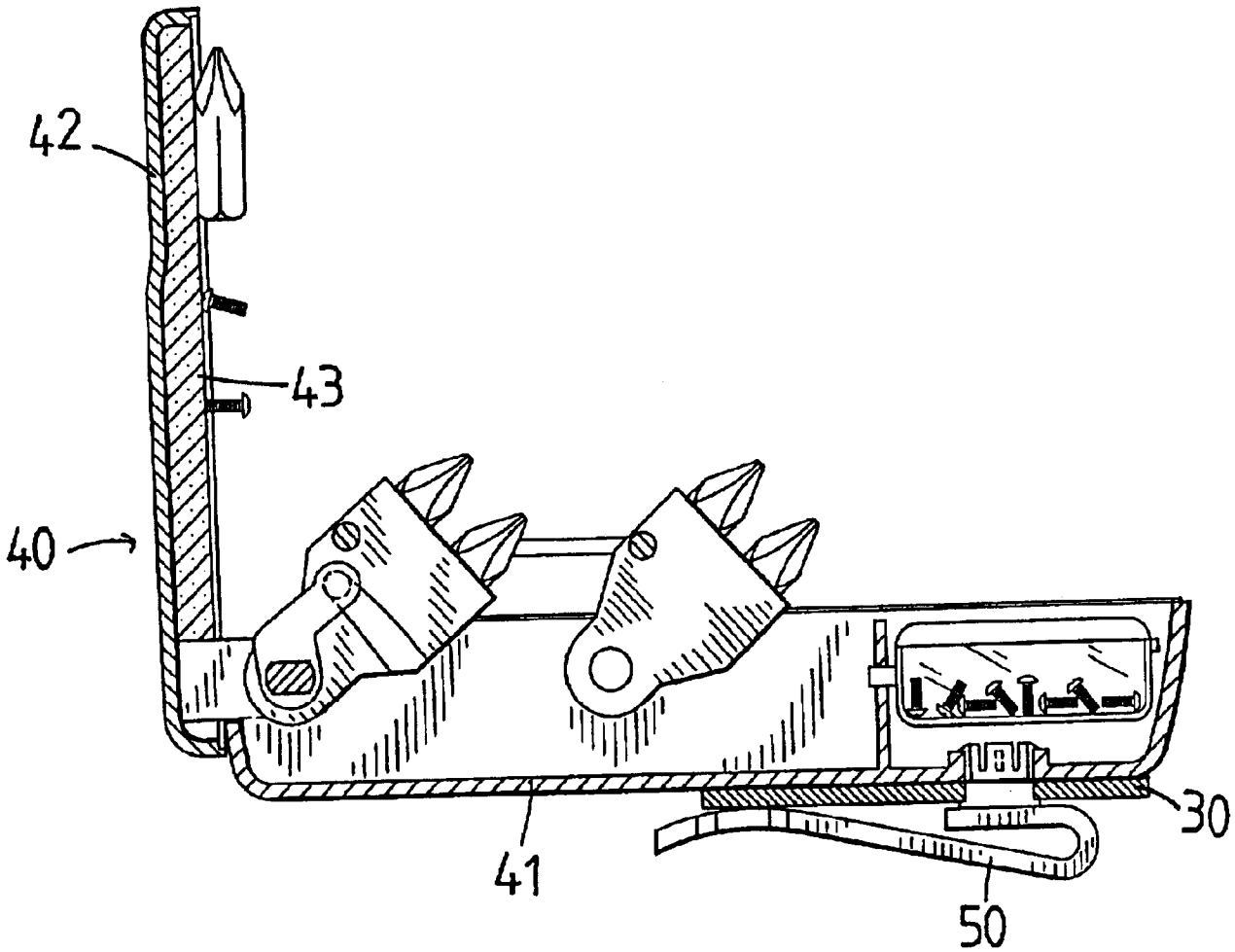
FIG. 7 is a cross sectional view to show the tool box on the board.

A tool retainer 60 is connected to the second part 32 and includes two clamp lugs 61 so that a screwdriver may extends through the tool retainer 60 and the two clamp lugs 61 clamp the handle of the screwdriver. Two frames 91, 92 extend from a side of the second part 32 and a socket 94 is pivotably connected between the two frames 91, 92 by extending two extensions 941 extending radially from the socket 94 into the holes 911 in the two frames 91, 92. A stop 93 extends from the second part 32 and is located on an extension of a center line between the two frames 91, 92. Each of the two frames 91, 92 has a lip 912 extending from an inside of a remote end thereof. A support member 80 is connected on the second part 32 and includes a recess portion 81 so that a tool is supported on the support member 80 and its hexagonal shank is inserted in the socket 94. The tool can be pivoted an angle about the two extensions 941 so that the user can easily pull the tool as shown in FIG. 6. The stop 93 prevents the shank from protruding beyond the stop 93, and the two lips 912 position the socket 94 from randomly pivoting if the user does not want the tool to be pivoted.

A first hanging member 50 has a first hook portion 52 connected to a first end thereof and a first engaging member 53 is connected to the first hook portion 52 which extends through the first hole 311 and is rotatably engaged with the first receiving hole 54 in the base 41. The first hanging member 50 has an aperture 51 defined through a second end thereof so as to hang the whole combination on desired position.

A second hanging member 70 has a second hook portion 72 and a second receiving hole 73 is defined through the second hook portion 72 of the second hanging member 70. The tool retainer 60 has a second engaging member 74 which extends through the second hole 321 and is rotatably engaged with the second receiving hole 73. The second hanging member 70 has an aperture 71 defined through a second end thereof so as to hang the whole combination on desired position.

Figure 8:
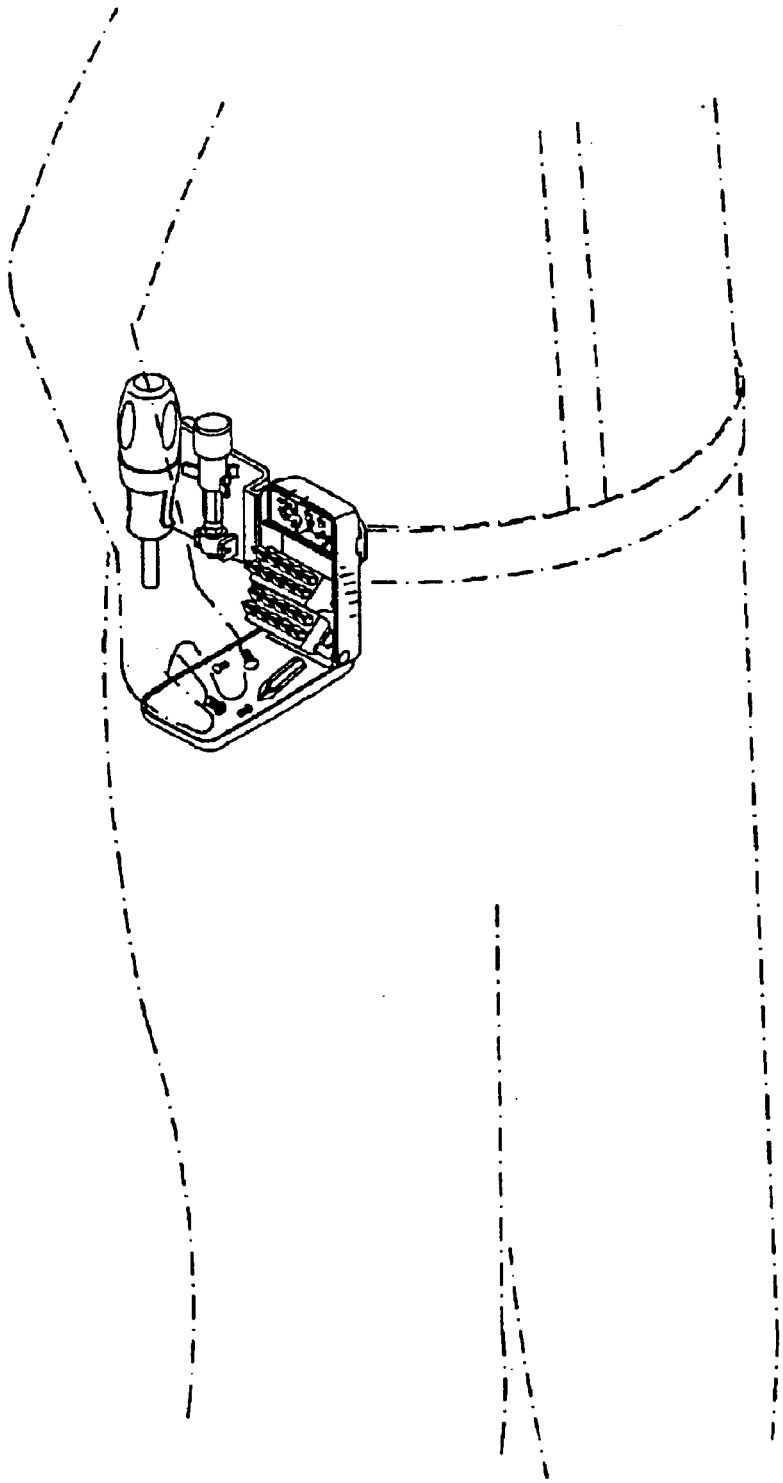
FIG. 8 shows the tool box is attached on a user's belt and small pieces can be positioned on the magnetic cover of the tool box.
Figure 10:
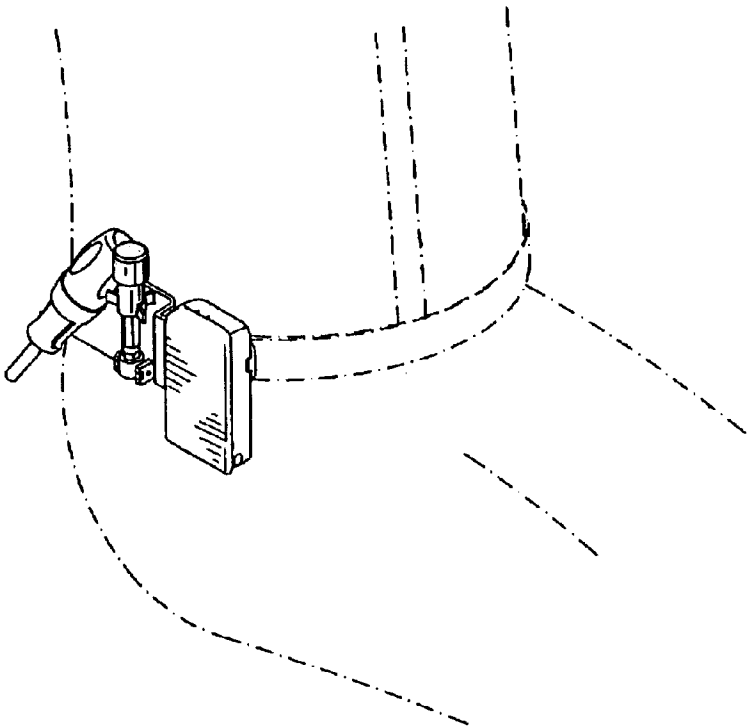
FIG. 10 shows the tool can be pivoted an angle when the user is sitting.
Figure 9:
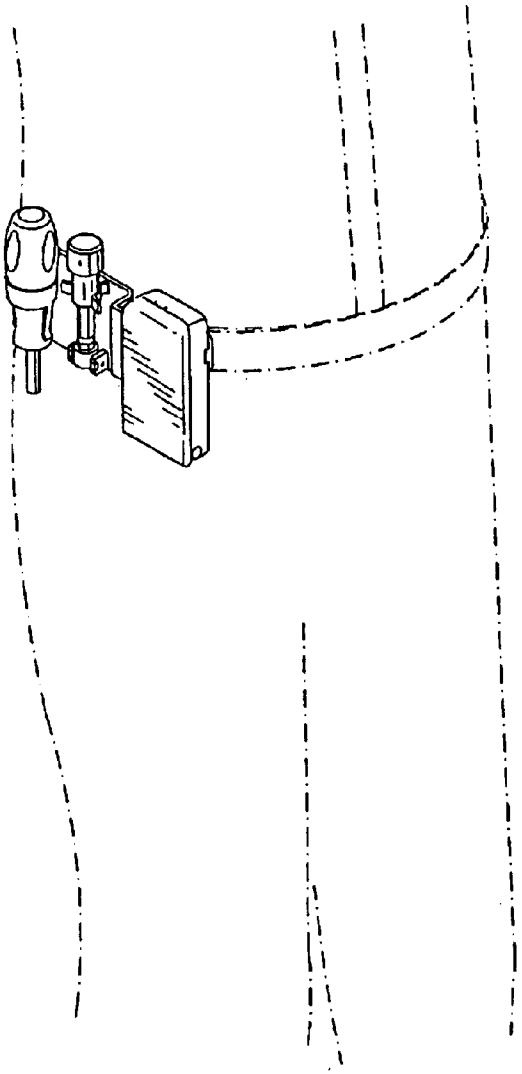
FIG. 9 shows the tool box and the board are attached to the user's belt when the user is standing.

As shown in FIG. 8, the hanging members 50, 70 allow the board 30 with the tool box 40 to be attached to the user's belt and the opened cover 42 can used to position small pieces by its magnetic member 43. FIGS. 9 and 10 shows that the tool retainer 60 can be easily pivoted an angle so that the screwdriver will not affect the pose when the user is sitting in a chair.

While we have shown and described the embodiment in accordance with the present invention, it should be clear to those skilled in the art that further embodiments may be made without departing from the scope of the present invention.

What is claimed is:

1. A combination of tool box and hanging members, comprising:

a board having a first part which has a first hole defined therethrough, a first ridge and a second ridge extending from a side of the board;

a tool box having a base and a cover which is pivotably connected to the base, the base having a first receiving hole defined therethrough and a magnetic member connected to an inside of the cover, the base being clamped between the first ridge and the second ridge, and a first hanging member having a first hook portion connected to a first end thereof, a first engaging member connected to the first hook portion and rotatably engaged with the first receiving hole.

2. The combination as claimed in claim 1, wherein the first hanging member has an aperture defined through a second end thereof.

3. The combination as claimed in claim 1 further comprising a second part extending from the first ridge and located in opposite to the first part, a tool retainer connected to the second part and including two clamp lugs.

4. The combination as claimed in claim 3 further comprising a second hanging member which has a second hook portion, a second receiving hole defined through the second hook portion of the second hanging member, a second hole defined through the second part and the tool retainer having a second engaging member which extends through the second hole and is rotatably engaged with the second receiving hole.

5. The combination as claimed in claim 3, wherein two frames extend from a side of the second part and a socket is pivotably connected between the two frames, a support member connected on the second part and including a recess portion which is adapted to receive a tool.

6. The combination as claimed in claim 5, wherein each of the two frames has a lip extending from an inside of a remote end thereof.

7. The combination as claimed in claim 5 further comprising a stop extending from the second part and located on an extension of a center line between the two frames.

* * * * *